US006613168B2

(12) United States Patent
Reed, Jr. et al.

(10) Patent No.: US 6,613,168 B2
(45) Date of Patent: Sep. 2, 2003

(54) HIGH ENERGY PROPELLANT WITH REDUCED POLLUTION

(75) Inventors: Russell Reed, Jr., Santa Barbara, CA (US); David A. Ciaramitaro, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 179 days.

(21) Appl. No.: 09/872,427

(22) Filed: May 29, 2001

(65) Prior Publication Data

US 2003/0024617 A1 Feb. 6, 2003

(51) Int. Cl.[7] ..... C06B 45/10

(52) U.S. Cl. ..... 149/19.5; 149/19.6; 149/45; 149/114

(58) Field of Search ..... 149/19.4, 19.5, 149/19.6, 45, 114

(56) References Cited

U.S. PATENT DOCUMENTS 4,799,980 A 1/1989 Reed, Jr.
5,468,313 A * 11/1995 Wallace, II et al. ..... 149/53
5,498,303 A * 3/1996 Hinshaw et al. ..... 149/19.6
5,529,649 A * 6/1996 Lund et al. ..... 149/19.3
5,741,998 A * 4/1998 Hinshaw et al. ..... 149/19.6
6,179,899 B1 1/2001 Higa et al.

* cited by examiner

*Primary Examiner*—John Hardee
(74) *Attorney, Agent, or Firm*—Anthony J. Serventi; Charlene A. Haley

(57) ABSTRACT

This invention relates to energetic compositions, which offer increased performance in conjunction with a total absence of hydrogen chloride in the combustion products. The formulation avoid the use of halogen based oxidizers to prevent the formation of halogen based byproducts. The formulations disclosed herein use ammonium dinitramide as a primary oxidizer, which is a more energetic molecule than ammonium perchlorate. The solid propellant formulations disclosed herein comprise about 5.0 to about 10.0 weight % of at least one energetic binder; about 20.0 to about 35.0 weight % of an energetic plasticizer; about 25.0 to about 45.0 weight % of ammonium dinitramide as a primary oxidizer; about 0.0 to about 20.0 weight % of particulate aluminum having a particle size of about 1 $\mu$m to about 60 $\mu$m; and about 0.0 to about 20.0 weight % of ultrafine aluminum having a particle size of less than 1 $\mu$m. In addition to the ingredients in this basic formulation will be cure catalysts, curatives, crosslinkers, burn rate catalysts and modifiers, thermal and aging stabilizers other such ingredients commonly utilized in solid propellant formulations.

10 Claims, 1 Drawing Sheet

HIGH ENERGY PROPELLANT WITH REDUCED POLLUTION

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

This invention relates to propellant formulations and plastic bonded explosive compositions. More particularly, this invention relates to energetic compositions, which offer increased performance in conjunction with a total absence of hydrogen chloride in the combustion products.

2. Description of the Prior Art

State-of-the-art propellant formulations, at their most basic level, are composed of an oxidizer and a fuel. The combustion reaction undergone by these two materials provides the energy necessary to propel the rocket or missile. Since the oxidizer fuel combination must sustain the stresses of handling, aging, storage and use, it is typically compounded in a formula consisting of binder, plasticizer and various solid ingredients. Ideally, all the components in the formulation act as either oxidizers or fuels, contributing to the energy necessary for maximum propulsion performance, although in practice, certain necessary ingredients such as stabilizers and burn rate catalysts/modifiers, have little or no energy to impart to the reaction.

The performance of the propellant is directly proportional to the enthalpy release of the oxidizer and fuel ingredients as they undergo combustion, and inversely proportional to the molecular weight of the gases produced in the combustion reaction. In practice, some tradeoffs are necessary to gain the best performance from available ingredients and formulations. Aluminum, for instance, is a fuel whose combustion products are relatively high in molecular weight, and are in most cases, not gases at all, but solids. However, the enthalpy release by the combustion of aluminum is so great in proportion to anything else, which would otherwise be available as a fuel ingredient, that the metal is commonly used as a fuel in high-performance tactical and strategic rocket motor applications. Another material commonly utilized, despite some drawbacks, is the oxidizer ammonium perchlorate. This material has a high negative enthalpy of formation, limiting its energy release upon combustion, and, in addition, it produces hydrogen chloride upon combustion, a relatively high-molecular-weight toxic gas. However, ammonium perchlorate is inexpensive, easy to formulate, has very tractable ballistics and favorable burn characteristics, and so, despite its limitations, it is the state-of-the-art oxidizer for most solid propellant rocket motor formulations.

Ammonium dinitramide (ADN) is a very powerful inorganic oxidizer that can replace ammonium perchlorate (AP) in propellant compositions. Calculations have shown that, when incorporated in propellant formulations, the propellant can achieve performance equal to or higher than that of the conventional hydroxyl-terminated polybutadiene (HTPB)/AP propellant. Most desirably, ADN propellants do not produce toxic hydrogen chloride (HCl) in the exhaust. In addition, the use of ADN in propellant formulations greatly minimizes the secondary smoke problem caused by the nucleation of HCl Because of their environmentally friendly characteristics and demonstrated low toxicity of their exhaust products to humans, ADN propellants are highly desirable. In recent years, investigators have been designing propellant formulations that try to embody the advantages of ADN as a solid oxidizer.

The need to have missiles fly farther, higher and faster, and to carry heavier payloads is a constant tactical and strategic factor. Higher performance is always needed. In volume-limited systems, this performance can only come about by increases in the quantity, density or energy of the propellant formulation, by decreases in the weight of the inert hardware and the airframe, and by operating at higher pressures. A new requirement has come to light in recent years: that the formula and its combustion products be nondegrading to the environment. In the light of these requirements, state-of-the-art propellant formulations utilizing conventional binders, ammonium perchlorate and aluminum have been developed and refined to the maximum extent possible and these compositions will necessarily begin to fall behind in performance compared to newer developments. In addition, the political and environmental concerns with the toxic and corrosive hydrogen chloride present in the exhaust of rockets utilizing these formulations will result in demands to replace such formulations with more innocuous compositions. Below, a propellant formulation, which is a solution for both problems, is disclosed.

SUMMARY OF THE INVENTION

The solid propellant formulations disclosed herein exhibit superior properties without the negative environmental impact of existing propellants.

One object of a preferred embodiment of the present invention is to provide a solid propellant formulation comprising about 5.0 to about 10.0 weight % of at least one energetic binder; about 20.0 to about 35.0 weight % of an energetic plasticizer; about 25.0 to about 45.0 weight % of ammonium dinitramide as a primary oxidizer; about 0.0 to about 20.0 weight % of particulate aluminum having a particle size of about 1 $\mu$m to about 60 $\mu$m; and about 0.0 to about 20.0 weight % of particulate aluminum having a particle size of less than 1 $\mu$m. In addition to the ingredients in this basic formulation will be cure catalysts, curatives, crosslinkers, burn rate catalysts and modifiers, thermal and aging stabilizers, opacifiers and other such ingredients commonly utilized in solid propellant formulations.

One object of a preferred embodiment of the present invention is to provide a solid rocket propellant, which offers increased performance in conjunction with a total absence of hydrogen chloride in the combustion products.

Another object of a preferred embodiment of the present invention is to provide a solid rocket propellant, which eliminates halogen-containing compounds from the combustion products while maintaining good performance and good mechanical properties.

A still further object of a preferred embodiment of the present invention is to provide a solid propellant formulation, which utilizes ADN as an oxidizer to greatly minimize the secondary smoke problem caused by the nucleation of HCl in AP.

DETAILED DESCRIPTION

Figure 1:
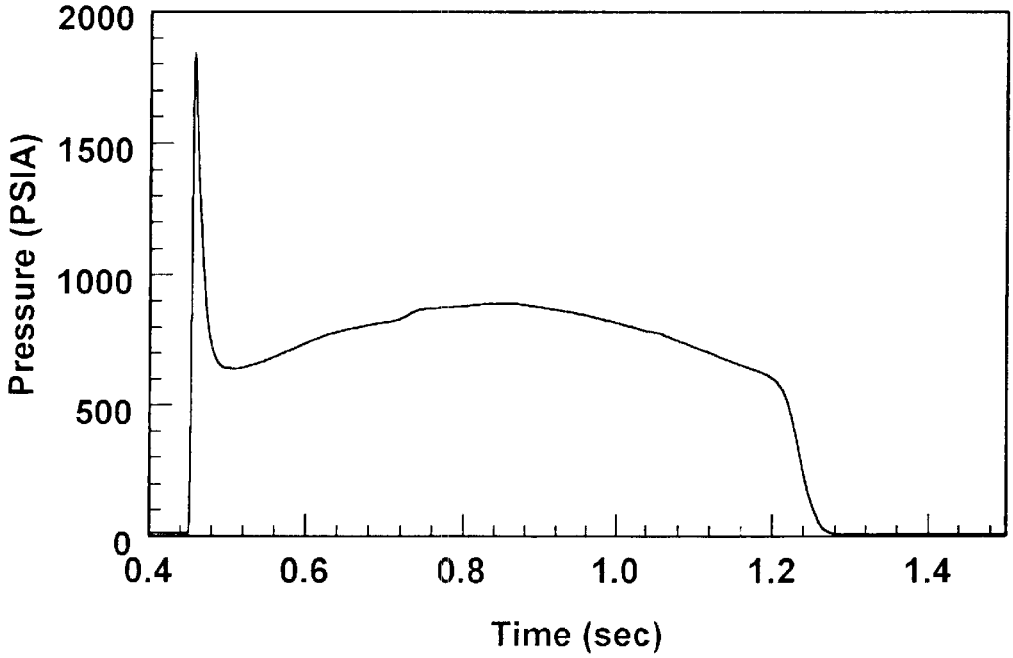
FIG. 1 is a graph of the performance of a preferred embodiment of the present invention which illustrates that the formulations of the current invention act as propellants.

A preferred embodiment of the present invention is a formulation based on new propellant ingredients, which offers increased performance in conjunction with a total absence of hydrogen chloride in the combustion products The propellant of the instant invention is comprised of a binder, an energetic plasticizer, ammonium dinitramide as the oxidizer and aluminum as the fuel The resultant formulations avoid the production of hydrogen chloride and provide propellants, which increase the energy without a concomitant decrease in the burn rate.

The energetic plasticizer is selected from those compounds, which are liquids and contain energetic moieties or groups in their chemical structures. These moieties can include nitro or nitrate ester groups, azido groups, or nitramino groups. Examples include butanetriol trinitrate (BTTN), triethylene glycol dinitrate (TEGDN), nitroglycerine (NG) glycidyl azide polymer terminated with azide (GAP azide or GAP Plasticizer), bis-(2,2-dinitropropyl) acetal/formal (BDNPF/A) and butyl nitratoethylnitramine (Bu-NENA) Fluoramino groups such as bis-(2,2-ro-2-fluoroethyl) formal (FEFO), bis[2,2-bis(difluoramino)-5,5-dinitro-5-fluoropentoxy] methane (SYFO) and trifluoroethyl-terminated poly (1-cyano-1-difluoramino)-polyethylene glycol (PCDE P-2) may be used in the formulations. However, the inclusion of the fluorine-containing plasticizers introduces halogen compounds into the exhaust. Although HF is more toxic than HCl, propellants containing fluorine plasticizers produce substantially less HF than the HCl produced by AP-containing propellants. As a result, the formulations of the present invention may use fluorine-containing plasticizers to produce propellants, which are more environmentally friendly than AP-containing propellants. Fluorine-containing plasticizers might be useful in those cases where the disadvantage of HF-containing exhaust may be traded off in order to obtain increased density in the formulation. In a preferred embodiment of the present invention, the plasicizer is halogen free and comprises from about 20 weight % to about 35 weight % of the formulation. More preferably, the plasicizer is halogen free and comprises about 30 weight % of the formulation. The energetic plasticizer used in the examples is BTTN.

The binder is selected from those oligomers and polymers known as "energetic binders." Energetic binders may be energetic compounds themselves, such as azides, nitrate esters or nitrocompounds, which have been polymerized into oligomers with prosthetic groups on the ends of the polymers for crosslinking or curing. Also, energetic binders may be oligomers, polymers or copolymers of organic esters, ethers, lactones which have the property of absorbing large amounts of energetic plasticizers (typically at least three times their weight) without exudation or degradation of mechanical properties. Examples of the former include glycidyl azide polymer (GAP), the copolymer of (bis-azidoethyl) oxetane (BAMO) with (3-nitratomethyl-3-methyl) oxetane (NMMO), called BAMO/NMMO, other polymers or copolymers of the same type utilizing such molecules as 3-azidomethyl-3-methyl oxetane (AMMO), bis-(nitratomethyl) oxetane (BNMO) and the like, and polyglycidyl nitrate (PGN or poly Glyn). Examples of the latter include polyethylene glycol (PEG), polypropylene glycol (PPG), hydroxy-terminated polycaprolactones, hydroxy-terminated polyesters, hydroxy-terminated polyethers (HTPE) and combinations of these polymers and oligomers; i.e, hydroxy-terminated polycaprolactone ether (HTCE). Fluoramines such as hydroxy-terminated poly (1-cyano-1-difluoramino)-polyethylene glycol (PCDE) may be used in the formulations of the present invention. However, the inclusion of the fluorine-containing binders would reintroduce halogen compounds into the rocket exhaust. Although HF is more toxic than HCl, propellants containing fluorine binders produce substantially less HF than the HCl produced by AP-containing propellants. As a result, the formulations of the present invention may use fluorine-containing binders to produce propellants, which are more environmentally friendly than AP-containing propellants. In a preferred embodiment of the present invention, the energetic binder is halogen free and comprises from about 5 weight % to about 15 weight % of the formulation. More preferably, the energetic binder is halogen free and comprises about 9 weight % of the formulation.

In a preferred embodiment of the present invention, the binder is a tetrahydroxy-terminated polyalkylene oxide (PAO) of about 24,000 daltons molecular weight, having four chains radiating out of a central carbon atom, and each chain terminated by a hydroxy group, which provides the functional group for curing and crosslinking. The chains are synthesized by the attachment of about 17 ethylene oxide moieties with two units of propylene oxide. These oligomeric chains are reacted with pentaerythritol, which forms the center of four radiating chains. This molecule is further extended along each chain with about 84 more ethylene oxide units, which terminate in hydroxy groups. This tetra star polyol and others of its type are described in U.S. Pat. No. 4,799,980 issued to Russell Reed, Jr. on Jan. 24, 1989, incorporated by reference herein, and are made by the BASF Corporation under the name PLURADYNE® 2413 or PAO 24-13. In addition to being tolerant of high levels of energetic plasticizers without loss of mechanical properties, PAO 24-13 also appears to bind well with the oxidizer of choice, ADN, allowing superior mechanical properties without the necessity of utilizing bonding agents.

The oxidizer ammonium dinitramide (ADN) is used as the replacement oxidizer for the more conventional ammonium perchlorate (AP) typically utilized in propellant formulations. ADN has a much more favorable enthalpy of reaction than AP, giving more energy and more performance in the formulation. Performance is further enhanced by the lack of hydrogen chloride in the exhaust products of ADN combustion. Hydrogen chloride has a relatively high molecular weight, and rocket motor performance generally decreases with the increasing molecular weight of the gaseous products of combustion. In addition, the hydrogen chloride is a corrosive and toxic gas, which is viewed as an atmospheric pollutant, and it tends to attract water from the atmosphere, forming an undesirable visible plume of hydrochloric acid aerosol. Current strategic high-energy propellant formulations utilizing AP have been made by utilizing cyclotetramethylenetetranitramine (HMX) to increase the energy of the mixture. The use of this ingredient has the undesirable side effect of lowering the burning rate of these formulations. The use of ADN in our formulations allows the energy increase without a concomitant decrease in the burn rate. ADN material is usable in either spherical shape or crystalline with an average size of 5 to 200 $\mu$m. The crystalline ADN is given the name "neat ADN" and the spherical shaped like ADN is given the name "prilled ADN". In a preferred embodiment of the present invention, the ADN material appears to be in either crystalline form, neat ADN, or spherical shaped, prilled ADN, with an average size of 5 to 200 $\mu$m. In a preferred embodiment of the present invention, the ADN comprises from about 25 weight % to about 45 weight % of the formulation. More preferably, the ADN comprises about 39 weight % of the formulation.

In a preferred embodiment of the present invention, aluminum is used as the metal fuel. Particulate aluminum is highly desirable in propellant formulations, if the highest possible performance is demanded. Most of the products of aluminum combustion are solids, which impair performance, but this reduction is more than offset by the large enthalpy gain and increased heat of reaction when aluminum is included. In the prior art, typical particulate aluminum used as propellant ingredient ranges in particle size from about 5 microns to about 60 microns. Efficient combustion of this aluminum is mandatory in order to capitalize on the increased energy afforded by inclusion of the metal into the formulation. In the past, the only way to achieve such efficiency was by the inclusion of halogen containing oxidizers into the formulation, whose combustion products would increase the combustion efficiency of aluminum. Although some fluorinated polymers can assist in this efficiency enhancement, generally, a much greater amount of halogen is needed than that provided by binders, which are typically minimized in propellant formulations to provide the maximum proportion of oxidizers and fuels. The typical solution in the past has been the use of AP in the formulation, which provides a molecule of HCl for every molecule of AP reacted, and keeps the aluminum particle in an atmosphere rich in halogen for the most efficient combustion.

All aluminum preparations have a coating of aluminum oxide on the surface, which is a refractory, chemically inert material and protects the aluminum underneath from further oxidation. When a particle of aluminum is introduced into a combustion reaction, the aluminum will melt inside the inert oxide shell, will further heat and expand until the shell either cracks or melts. The aluminum particle, its metal surface exposed, assumes a spherical shape and then catches fire and burns, generating more molten aluminum oxide, which typically collects in a patch or cap covering part of the spherical surface. The aluminum combustion products stream off the burning surface as aluminum oxide smoke, and collect at the cap, increasing its size. The aluminum in the particle eventually burns completely, and the cap of oxide either is ejected in the gas stream of the combustion or coagulates with other molten aluminum oxide caps to form slag on the bottom of the burning material.

To gain the maximum performance enhancement, aluminum combustion must be as rapid as the combustion of the rest of the ingredients in the formulation. To realize any performance gain at all by the presence of aluminum in the propellant, the aluminum combustion must be complete within the "dwell time" of the gases in the chamber of the rocket motor, i.e., before the exhaust stream takes the burning particle and its remaining energy out of the nozzle. Some of the products of aluminum combustion are gases and liquids at typical motor combustion temperatures, and later react or disproportionate to form solid aluminum oxide. Solid material ejected from the nozzle along with the gases is an undesirable condition also called "two-phase flow," and the presence of the solid phase generally decreases motor performance. It is thus important to have the aluminum burn as quickly as possible, so the maximum energy is converted to thrust within the motor and the minimum proportion of the unburned and solid particles are ejected from the nozzle. It is also important to keep the aluminum oxide particles as small as possible, to reduce the two-phase flow losses. Unfortunately, in the absence of halogen in the combustion atmosphere, the time necessary for the aluminum particle to heat, melt, crack the oxide shell, catch fire, and burn can be longer than the dwell time for gases in the motor of a typical solid-fuel rocket. Window-bomb studies of such aluminized non-halogenated propellants show the burning aluminum particles ejected from the flame structure almost as soon as they catch fire. Completion of combustion is observed to occur at great distances from the burning surface of the propellant. These "sparklers" provide a visual diversion, but the energy is lost to the combustion reaction.

The recent discovery of submicron-particle-size preparations of aluminum, typically called "nanoaluminum" or "ultrafine aluminum" (UFA1), offers the formulator a way around the dilemma of realizing the maximum performance gain from aluminized formulations containing no halogen. UFA1, which has a particle size of less than 1 $\mu$m, can be prepared by electroexploding aluminum wires in inert atmospheres, by plasma-deposition processes and by chemical precipitation from decomposing alane species. One of the latter is described in U.S. Pat. No. 6,179,899 issued to Higa et al. on Jan. 30, 2001, which is incorporated by reference herein. Such preparations have oxide shells on the aluminum particles, but the enormous enhancement of surface area for the weight of the aluminum increases the speed of its ignition and combustion. Moreover, the combustion of nanoaluminum appears to provide an appreciable reduction in the time needed for conventional particulate aluminum to ignite and burn when preparations of the two materials are mixed into formulations. In a preferred embodiment of the present invention the total aluminum content, from particulate aluminum and UFA1, is about 20 weight % of the formulation. More preferably, equal amounts of UFA1 and conventional particulate aluminum are incorporated to provide combustion efficiency equivalent to the same percentage of conventional aluminum powder burned with AP. The formulation incorporating this change can have a theoretical specific impulse of 270 sec. or greater. In a preferred embodiment of the present invention, the UFA1 comprises from about 0 weight % to about 20 weight % of the formulation. More preferably, the UFA1 having an average size of less than 1 $\mu$m comprises about 10 weight % of the formulation. In a preferred embodiment of the present invention, the particulate aluminum having an average size of about 1 $\mu$m to about 60 $\mu$m comprises from about 0 weight % to about 20 weight % of the formulation. More preferably, the particulate aluminum comprises about 10 weight % of the formulation and has a particle size of about 30$\mu$m.

In a more preferred embodiment of the present invention illustrated in Table I, a high-energy, non-HCl-producing formulation is comprised of:

TABLE I

| Ingredient | Weight % (approximate) |
|---|---|
| Energetic Binder | 5–10% |
| Energetic Plasticizer | 20–35% |
| Ammonium Dinitramide | 25–45% |
| Particulate Aluminum >1 $\mu$m | 0–20% |
| Ultrafine Aluminum <1 $\mu$m | 0–20% |

In a more preferred embodiment of the invention illustrated in Table II, a high-energy, non-HCl-producing formulation is comprised of:

TABLE II

| Ingredient | Weight % (approximate) |
|---|---|
| PLURADYNE ® 2413 | 5–10% |
| Butanetriol Trinitrate | 20–35% |
| Ammonium Dinitramide | 25–45% |
| Particulate Aluminum >1 $\mu$m | 0–20% |
| Ultrafine Aluminum <1 $\mu$m | 0–20% |

As shown in Tables I and II, the basic formulation is comprised of metal fuel, oxidizer, energetic binder and energetic plasticizer. In addition to the ingredients in this basic formulation will be cure catalysts, curatives, crosslinkers, burn rate catalysts and modifiers, thermal and aging stabilizers, opacifiers and other such ingredients commonly utilized in solid propellant formulations.

Curatives and crosslinkers for the binder include applicable polyisocyanates, which react with the hydroxy groups on the ends of the polymer to form urethane linkages. The curatives and crosslinkers may include hexamethylene diisocyanate (HMDI), isophorone diisocyanate (IPDI), toluene diisocyanate (TDI), m-tetramethylxylene diisocyanate (TMXDI), dimeryl diisocyanate (DDI) and the polymeric hexamethylene diisocyanate, which has the trade designation of N-100™, commercially available from the Miles Corporation. These curatives may be used independently or in combination. The N-100™ polyisocyanate is used in a preferred embodiment of the present invention. In a preferred embodiment of the present invention, N-100™ is incorporated at about at about 0.925 weight %.

A suitable stabilizer is MNA (N-methyl-p-nitroaniline). Stabilizer is used to stabilize nitrate ester plasticizer and AN oxidizer in order to prolong shelf life. Other suitable stabilizers for nitrate esters include 2-NDPA (2-nitrodiphenylamine), and other stabilizers well known in the art. In a preferred embodiment of the present invention, MNA is incorporated at about at about 0.5 weight %.

A mixture of DNSA (3,5-dinitrosalicylic acid) and TPB (triphenyl bismuth) is a preferred cure catalyst. Other suitable cure catalysts include TPTC (triphenyltin chloride), dibutyltin diacetate, and dibutyltin dilaurate and mixtures thereof. These compounds and others may be used as needed to prepare a propellant formulation with the specific desired characteristics. In a preferred embodiment of the present invention, DNSA is incorporated at about at about 0.040 weight %.

Aluminum oxide is a suitable burn rate catalyst and is preferable to transition metal burn rate catalysts such as superfine iron oxide, chromic oxide, catocene, or carboranes. Aluminum oxide is less liable to interfere with propellant cures and to affect their aging than transition metal than transition metal burn rate catalysts and aluminum oxide gives better IM effects. In a preferred embodiment of the present invention, aluminum oxide comprises about 0.3–0.6 weight % of the formulation, preferably at about 0.5 weight %.

Experimental Results

Referring to Tables III and IV, when fired in small experimental 2×2 motors the formulations display advantageous characteristics. As illustrated in Table III, the characteristics of the formulations, corrected to sea level, include the following:

TABLE III

| Test | E-1930 | E-1931 | E-1932 | E-1933 |
|---|---|---|---|---|
| Amb.Temp. | 65° F. | 65° F. | 65° F. | 50° F. |
| Amb. Press. | 13.6 psia | 13.6 psia | 13.6 psia | 13.6 psia |
| Avg. Pressure | 774 psia | 827 psia | 1024 psia | 1055 psia |
| Avg. Expansion Ratio | 7.0:1 | 7.0:1 | 7.0:1 | 7.0:1 |
| Burn Rate in Motor | 0.624 ips | 0.668 ips | 0.761 ips | 0.749 ips |
| C* Delivered | 5002 ft/s | 5020 ft/s | 5086 ft/s | 5010 ft/s |
| C* Efficiency | 0.957 | 0.960 | 0.972 | 0.958 |

TABLE III-continued

| Test | E-1930 | E-1931 | E-1932 | E-1933 |
|---|---|---|---|---|
| Isp Delivered | 229.6 s | 234.4 s | 240.6 s | 235.7 s |
| Isp Efficiency | 0.889 | 0.902 | 0.912 | 0.892 |

TABLE IV

| | Weight % of each ingredient | | | |
|---|---|---|---|---|
| Composition | E-1930 | E-1931 | E1932 | E-1933 |
| Binder (PAO-24-13) | 9.033 | 9.033 | 9.033 | 9.033 |
| Crosslinker (N-100) | 0.925 | 0.925 | 0.925 | 0.925 |
| Plasticizer (BTTN) | 29.832 | 29.872 | 29.872 | 29.832 |
| AND, Recrystallized | 39.000 | 39.000 | 39.000 | 39.000 |
| Stabilizer (MNA) | 0.500 | 0.500 | 0.500 | 0.500 |
| UFAl | 10.000 | 10.000 | 10.000 | 10.000 |
| Aluminum, 30 μm | 10.000 | 10.000 | 10.000 | 10.000 |
| Burn Rate Catalyst (Aluminum Oxide) | 0.500 | 0.500 | 0.500 | 0.500 |
| T-12 | 0.170 | 0.170 | 0.170 | 0.170 |
| Cure Catalyst (DNSA) | 0.040 | — | — | 0.040 |

Despite the short residence time in the motor chamber, the aluminum appeared to burn efficiently, with no evidence of burning agglomerated droplets exiting the chamber until the propellant was almost burned out. The modeled burn rate, $r_b$, of the propellant, based on de St. Robert's Law, over the pressures attained, $P_c$, is described by the equation:

$$r_b = 0.7465\left(\frac{P_c}{1000}\right)^{0.6365}$$

Referring to FIG. 1, an example of the pressure and thrust curves for one of the motor firings is illustrated. FIG. 1 shows that the 2×2 motor used burns with a constant area, hence a constant pressure area. Further, FIG. 1 illustrates that the formulations of a preferred embodiment of the present invention act as propellants.

Although the description above contains many specificities, these should not be construed as limiting the scope of the invention but as merely providing an illustration of the presently preferred embodiment of the invention. Thus the scope of this invention should be determined by the appended claims and their legal equivalents.

What is claimed is:

1. A solid propellant formulation comprising:

about 5.0 to about 10.0 weight % of at least one energetic binder;

about 20.0 to about 35.0 weight % of an energetic plasticizer;

about 25.0 to about 45.0 weight % of ammonium dinitramide as a primary oxidizer;

about 10.0 weight % of particulate aluminum having a particle size in the range of about 1 μm to about 60 μm; and about 10.0 weight % of ultrafine aluminum having a particle size of less than 1 μm.

2. The solid propellant formulation of claim 1, wherein said energetic plasticizer is selected from the group consisting of butanetriol trinitrate, triethylene glycol dinitrate, nitroglycerine glycidyl azide polymer terminated with azide, bis-(2,2-dinitropropyl) acetal/formal and butyl nitratoethylnitramine.

3. The solid propellant formulation of claim 1, wherein said energetic plasticizer is butanetriol trinitrate.

4. The solid propellant formulation of claim 1, wherein said energetic binder is selected from the group consisting of glycidyl azide polymer, a copolymer of (bis-azidoethyl) oxetane with (3-nitratomethyl-3-methyl) oxetane, 3-azidomethyl-3-methyl oxetane, bis-(nitratomethyl) oxetane, polyglycidyl nitrate, hydroxy-terminated polycaprolactones, hydroxy-terminated polyesters, hydroxy-terminated polyethers, hydroxy-terminated polycaprolactone ether and a hydroxy-terminated polyalkylene oxide.

5. The solid propellant formulation of claim 1, wherein said energetic binder is a tetrahydroxy-terminated polyalkylene oxide having a molecular weight of about 24,000 daltons.

6. The solid propellant formulation of claim 1, further comprising at least one member selected from a curative, a crosslinker, a stabilizer, a cure catalyst, a burn rate catalyst, a burn rate modifier, an opacifier and a bonding agent.

7. The solid propellant formulation of claim 6, wherein said crosslinker is selected from the group consisting of hexamethylene diisocyanate, isophorone diisocyanate, toluene diisocyanate and polymeric hexamethylene diisocyanate.

8. The solid propellant formulation of claim 6, wherein said burn rate catalyst is aluminum oxide.

9. The solid propellant formulation of claim 6, wherein said cure catalyst is selected from the group consisting of triphenyl bismuth, triphenyltin chloride, dibutyltin diacetate and dibutyltin dilaurate.

10. The solid propellant formulation of claim 6, wherein said curative is selected from the group consisting of hexamethylene diisocyanate, isophorone diisocyanate, toluene diisocyanate and the polymeric hexamethylene diisocyanate.

* * * * *